United States Patent [19]

Marceaux

[11] 4,050,105

[45] Sept. 27, 1977

[54] DISPOSABLE TOILET SEAT COVER

[75] Inventor: Lionel J. Marceaux, Abbeville, La.

[73] Assignee: The Raymond Lee Organization, Inc., New York, N.Y. ; a part interest

[21] Appl. No.: 672,052

[22] Filed: Mar. 31, 1976

[51] Int. Cl.[2] ..... A47K 13/14

[52] U.S. Cl. ..... 4/243; 4/242

[58] Field of Search ..... 4/243, 247, 245, 246, 4/244

[56] References Cited

U.S. PATENT DOCUMENTS

| | | | |
|---|---|---|---|
| 1,313,236 | 8/1919 | Mason | 4/243 |
| 1,377,541 | 5/1921 | Young | 4/243 |
| 1,582,527 | 4/1926 | Marks | 4/243 |
| 1,601,088 | 9/1926 | Sullivan et al. | 4/247 |
| 2,111,160 | 3/1938 | Weeks | 4/243 |
| 2,200,394 | 5/1940 | Leslie | 4/243 |
| 2,241,171 | 5/1941 | Wallace | 4/243 |
| 2,312,589 | 3/1943 | Reeves | 4/243 |
| 3,851,341 | 12/1974 | Aoyama | 4/243 |

*Primary Examiner*—Henry K. Artis

*Attorney, Agent, or Firm*—Daniel Jay Tick

[57] ABSTRACT

A cover has the contour and shape of the top surface area of a toilet seat, but larger dimensions so that it hangs over the outer side of the toilet seat. The paper comprises paper flushable in a toilet. The paper is positionable on the top surface area of the toilet seat, foldable over the outer side of the seat, and positionable on the bottom surface area of the seat to maintain it in position.

1 Claim, 4 Drawing Figures

DISPOSABLE TOILET SEAT COVER

BACKGROUND OF THE INVENTION

The present invention relates to a disposable toilet seat cover. More particularly, the invention relates to a disposable toilet seat cover for a toilet seat having a top surface area for accommodating a user, and inner side and outer side providing a specific contour and shape, and a bottom surface area opposite the top surface area.

Objects of the invention are to provide a disposable toilet seat cover of simple structure, which is inexpensive in manufacture, removably provided on toilet seats with facility and convenience to permit use of strange toilets hygienically, readily disposable after use by flushing, and foldable with facility and convenience so that a number of such seat covers may be carried in a pocket or handbag.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 4:
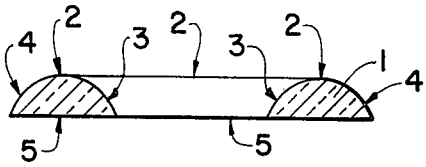
FIG. 4 is a cross-sectional view of a toilet seat.

The disposable toilet seat cover of the invention is for a toilet seat 1 (FIGS. 1 and 2) having a top surface area 2 (FIG. 4) for accommodating a user. As shown in FIG. 4, the toilet seat has an inner side 3 and an outer side 4 providing a specific contour and shape. The toilet seat 1, as shown in FIG. 4, also has a bottom surface area 5 opposite the top surface area 2.

Figure 2:
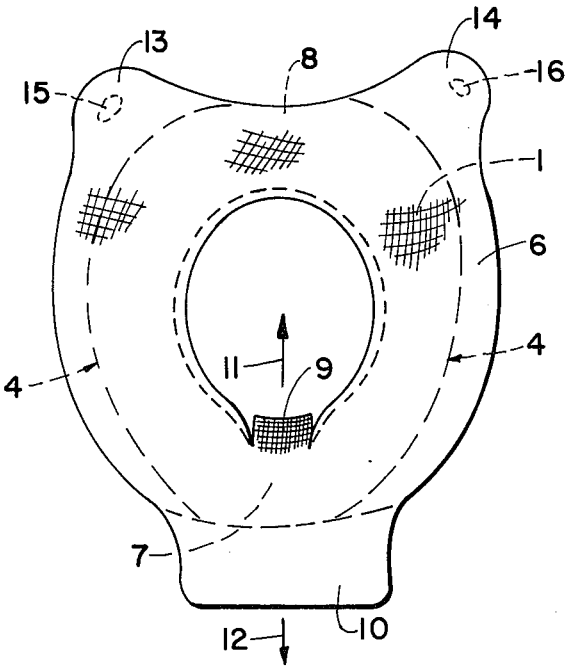
FIG. 2 is a top view of the embodiment of FIG. 1 prior to folding over a toilet seat.

The disposable toilet seat cover of the invention comprises a cover 6 having the contour and shape of the top surface area 2 of the toilet seat 1, but larger dimensions, as indicated in FIG. 2, so that it hangs over the outer side 4 of said toilet seat.

The cover 6 comprises paper flushable in a toilet. The paper is of any suitable type and preferably comprises tissue type paper. The paper of the cover 6 is positionable on the top surface area 2 of the toilet seat 1.

Figure 1:
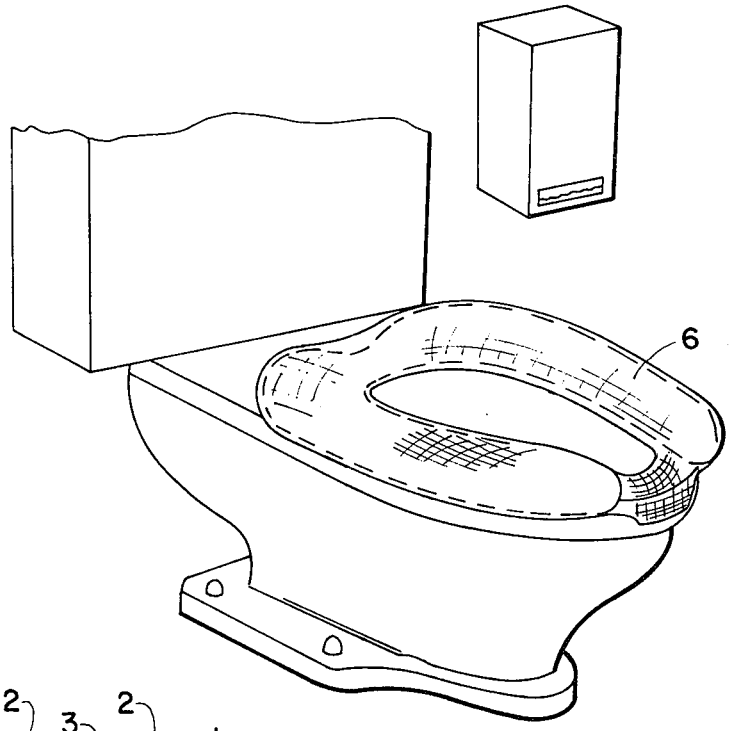
FIG. 1 is a perspective view of an embodiment of the disposable toilet seat cover of the invention in use.
Figure 3:
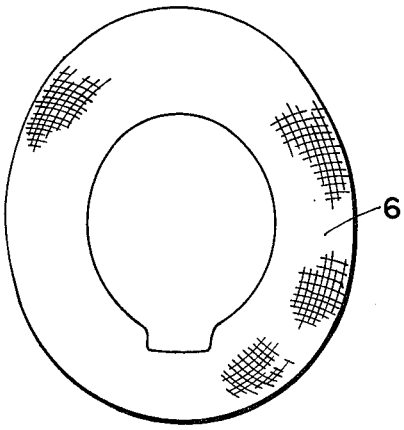
FIG. 3 is a top view of the embodiment of FIG. 2 after it has been folded to removably secure it in position.

As shown in FIGS. 1, 2 and 3, the cover 6 is foldable over the outer side 4 of the toilet seat 1 and is positionable on the bottom surface area 5 of said toilet seat to maintain it in position.

As shown in FIG. 2, the toilet seat 1 has a front central part 7 and a back part 8. The cover 6 comprises an inner center flap 9 positioned at the front central part 7 of the toilet seat and an outer center flap 10 positioned at the front central part of the toilet seat. The inner flap 9 extends inwardly, in the direction of an arrow 11 of FIG. 2, and the outer flap 10 extends outwardly, in the directon of an arrow 12 in FIG. 2, and both flaps are foldable over the front central part 7 of the toilet seat and are positionable on the bottom surface area 5 of said toilet seat.

The cover 6 further comprises a pair of spaced flaps 13 and 14 (FIG. 2) positioned at the back part 8 of the toilet seat 1 and extending beyond said seat outwardly. The flaps 13 and 14 are foldable over the back part 8 of the toilet seat and are positionable on the bottom surface area 5 of said toilet seat. Thus, as shown in FIG. 2, the cover 6 is folded along the broken line representing the outer side 4 of the toilet seat 1. After the flaps 9, 10, 13 and 14 have been folded, as hereinbefore indicated, the cover is neatly, removably secured to the seat, as indicated in FIGS. 1 and 3.

Spots 15 and 16 of self-adhesive material of any suitable type may be provided on the back flaps 13 and 14, as shown in FIG. 2, for removably affixing the cover 6 to the bottom surface area of the toilet seat 1.

While the invention has been described by means of a specific example and in a specific embodiment, I do not wish to be limited thereto, for obvious modifications will occur to those skilled in the art without departing from the spirit and scope of the invention.

I claim:

1. A disposable toilet seat cover for a toilet seat having a top surface area for accommodating a user, a front central part, a back part, an inner side and an outer side providing a specific contour and shape, and a bottom surface area opposite the top surface area, said disposable toilet seat cover comprising a cover having the contour and shape of the top surface area of a toilet seat but larger dimensions so that it hangs over the outer side of the toilet seat, said cover comprising paper flushable in a toilet, said paper being positionable on the top surface area of the toilet seat, foldable over the outer side of the toilet seat, and positionable on the bottom surface area of the toilet seat to maintain it in position, said cover having an inner center flap and an outer center flap consisting solely of paper and positioned at the front central part of the toilet seat, extending beyond said cover inwardly and outwardly, respectively, and foldable over the front central part of said toilet seat and positionable on the bottom surface area of said toilet seat, and having a pair of spaced flaps consisting solely of paper and positioned at the back part of the toilet seat, extending beyond said seat outwardly and foldable over the back part of said toilet seat and positionable on the bottom surface area of of said toilet seat, said flaps having self-adhesive thereon for removely affixing the cover to the bottom surface area of the toilet seat.

* * * * *